US008388264B2

(12) United States Patent
Grahl

(10) Patent No.: US 8,388,264 B2
(45) Date of Patent: Mar. 5, 2013

(54) METHOD AND APPARATUS FOR CONTROLLING ENGINE SPEED OF A SELF-PROPELLED POWER TROWEL DURING HIGH LOAD CONDITIONS

(75) Inventor: Scott Grahl, St. Cloud, WI (US)

(73) Assignee: Wacker Neuson Production Americas LLC, Menomonee Falls, WI (US)

( * ) Notice: Subject to any disclaimer, the term of this patent is extended or adjusted under 35 U.S.C. 154(b) by 153 days.

(21) Appl. No.: 12/976,469

(22) Filed: Dec. 22, 2010

(65) Prior Publication Data

US 2012/0163914 A1 Jun. 28, 2012

(51) Int. Cl.
*E01C 19/22* (2006.01)

(52) U.S. Cl. ..... 404/112

(58) Field of Classification Search ..... 404/112; 451/353

See application file for complete search history.

(56) References Cited

U.S. PATENT DOCUMENTS

| | | | | |
|---|---|---|---|---|
| 5,632,570 | A * | 5/1997 | Balling | 404/112 |
| 5,816,740 | A | 10/1998 | Jaszkowiak | |
| 5,890,833 | A | 4/1999 | Allen et al. | |
| 6,048,130 | A | 4/2000 | Allen et al. | |
| 6,053,660 | A | 4/2000 | Allen et al. | |
| 6,089,786 | A | 7/2000 | Allen et al. | |
| 6,106,193 | A | 8/2000 | Allen et al. | |
| 6,250,844 | B1 * | 6/2001 | Sartler et al. | 404/112 |
| 7,690,864 | B2 | 4/2010 | Allen et al. | |
| 7,775,740 | B2 | 8/2010 | Berritta | |
| 2005/0100405 | A1 * | 5/2005 | Jenkins et al. | 404/112 |
| 2009/0169300 | A1 * | 7/2009 | Allen et al. | 404/112 |
| 2010/0254763 | A1 | 10/2010 | Grahl | |
| 2011/0033235 | A1 * | 2/2011 | Leggitt et al. | 404/112 |
| 2011/0222966 | A1 * | 9/2011 | Allen et al. | 404/103 |

* cited by examiner

*Primary Examiner* — Robert Pezzuto
*Assistant Examiner* — Matthew D Troutman
(74) *Attorney, Agent, or Firm* — Boyle Fredrickson, S.C.

(57) ABSTRACT

A self-propelled concrete finishing trowel has an electronically controlled engine droop control to prevent stalling of the trowel's engine during overload conditions. The engine droop control includes an engine speed sensor that measures operating speed of the engine and a controller that adjusts operation of a hydrostatic drive system of the trowel based on feedback received from the engine speed sensor to reduce the power draw on the engine during overload conditions. The hydrostatic drive system is powered by the engine to rotate one or more finishing blade arrangements, and under normal operating conditions, is driven by a controller to rotate the blade arrangements at an operator desired speed, such as input by a foot pedal. During overloading conditions, the controller overrides the operator input to drive the hydrostatic drive system to match an operating speed supported by the overloaded engine to reduce the power draw on the engine and thereby prevent engine stalling.

18 Claims, 4 Drawing Sheets

METHOD AND APPARATUS FOR CONTROLLING ENGINE SPEED OF A SELF-PROPELLED POWER TROWEL DURING HIGH LOAD CONDITIONS

BACKGROUND OF THE INVENTION

1. Field of the Invention

The present invention relates generally to concrete finishing machines and, more particularly, to riding concrete trowels having engine droop control.

2. Discussion of the Related Art

A variety of machines are available for smoothing wet and partially cured concrete. These machines range from simple hand trowels, to walk-behind trowels, to self-propelled riding trowels. Regardless of the mode of operation of such trowels, the powered trowels generally include one or more rotors that rotate relative to the concrete surface. Riding finishing trowels can generally finish large sections of concrete more rapidly and efficiently than manually pushed or guided hand-held or walk behind finishing trowels.

Riding concrete finishing trowels typically include a frame having a cage that generally encloses two, and sometimes three or more, rotor assemblies. Each rotor assembly includes a driven vertical shaft and a plurality of trowel blades mounted on and extending radially outwardly from the bottom end of the driven shaft. The driven shafts of the rotor assemblies are driven to rotate at a commanded speed. The machine is steered by tilting one or more of the rotor assembles side-to-side to move the machine forward or reverse or fore-to-aft to propel the machine to the left or to the right. The pitch or flatness of the blades can also be adjusted to adjust the machine's finishing characteristics.

Trowels traditionally were powered by a gearbox mechanically coupled to an internal combustion engine and were steered manually using a lever assembly coupled to the gearbox assemblies by linkage assemblies. More recently, larger trowels have been introduced that are potentially fatiguing to steer manually. These trowels are steered via electrically or hydraulically powered actuators responsive to operator manipulation of joysticks. Some of the hydraulically steered trowels are also powered hydraulically via a hydrostatic drive system powered by the machine's internal combustion engine. The engine is driven at full throttle whenever the rotors are being driven, and rotor speed is adjusted by proportional control of the hydrostatic drive system. Specifically, a foot pedal or similar input device allows the operator to input a commanded rotational speed for the rotor assemblies. A controller provides command signals to a proportional control valve of the hydrostatic drive system based on the foot pedal position to adjust the output control of a variable output hydraulic pump to rotate the rotor assemblies at the operator-desired rotational speed. Operators typically operate the machine at full rotor speed through the vast majority of the machine's operational cycle.

The frictional load between the finishing blades and the concrete surface will vary continuously with concrete curing time, concrete mix, temperature and other ambient conditions, such as humidity. Therefore, as the concrete conditions change, the load placed on the engine will also change. For instance, the load placed on the engine can be much higher for wetter concrete, especially if the pitch of the finishing blades is not appropriate, e.g., is too steep. As the load on the engine increases, it is not uncommon for the operator to continue to demand maximum or full rotor speed notwithstanding the fact that the power being required of the engine is greater than the engine can provide. As a result, the increased load placed on the engine causes the engine to slow down, resulting in a noticeable reduction in power and rotor speed. An operator's natural response to such a decrease is to decrease the foot pedal further, if possible, to increase the rotor speed. Such an increase in demand will impose still more load on the already-overloaded engine. Whether or not additional power output is demanded, the overloaded engine may continue to slow and, in some cases, stall if the operator does not reduce the demand placed on the engine by letting up on the pedal. Additionally, exposing the engine to overloaded conditions over extended periods of time can reduce the engine life.

Accordingly, there is a need in the art to reduce engine overloading in hydraulically powered rotary trowels.

One proposed solution uses a drive motor pressure monitoring valve that monitors the pressure in a selected drive motor, e.g., the most downstream motor. In this proposed solution, the pressure in the selected drive motor is taken as indication of motor torque and, thus, as an indication of the demand being placed on the engine by the hydrostatic drive system. If the motor torque, as measured by the pressure monitoring valve, exceeds a desired torque, a relief valve is actuated to cut or decrease the input control pressure on a pilot pressure circuit in order to reduce rotor speed and reduce the load on the engine. It has been found that this proposed solution is unduly sensitive to system parameters such as motor efficiency and relief valve setting. The system may "hunt" or continuously and rapidly cycle between full-rotor-speed and reduced speed. Moreover, the proposed solution was found to display undesirable rotor performance during high load conditions, such as rotor stalling or an unacceptable decrease in engine speed.

Another drawback of this proposed solution is that since the relief valve is actuated based on a "threshold pressure", an increase in applied torque is not possible once the relief valve is actuated. In other words, the pressure in the load circuit is a direct indication of the frictional torque demand on the concrete. Therefore, when the pressure threshold is reached, the available torque applied is at a maximum and additional torque is not available.

SUMMARY OF THE INVENTION

The present invention provides an electronically controlled engine droop control that overcomes the aforementioned drawbacks. The engine droop control is effective in preventing engine stalling by reducing the demand placed on the engine by the hydrostatic drive system of a rotary trowel during high load conditions irrespective of the operator demanded rotor speed. More particularly, the invention includes a controller that monitors engine speed and that reduces the power draw of the hydrostatic drive system when the engine speed drops below a designated threshold. The threshold may, for example, be a pre-selected speed that is relatively close to the maximum rated engine speed. This control decreases the load placed on the engine, thereby enabling continued stall-free operation of the engine. After the engine load lessens, the controller returns operation of the hydrostatic drive system to rotate the finishing blades at the operator desired speed. Hence, the engine droop control of the present invention adjusts the pressure/flow ratio in the hydrostatic drive system to decrease engine power draw during high load conditions and then readjusts the pressure/flow ratio to a ratio that corresponds to an operator-desired blade rotating speed once engine load is lessened to enable increased power draw. The system thus performs an operation that is analogous to that performed by a vehicular automatic transmission that automatically downshifts when engine load exceeds a designated threshold.

In accordance with one aspect of the invention, the present invention provides a method and apparatus for preventing engine stalling in a power trowel during high load conditions.

In accordance with a further aspect of the invention, an engine droop control system includes an engine sensor that monitors the speed of an engine providing power to a hydrostatic drive system of self-propelled power trowel. The control system further includes a controller that controls the hydrostatic drive system to reduce the speed of rotor rotation when the load placed on the engine, as reflected by monitored engine speed, exceeds a predefined threshold.

The present invention may also be embodied in a control method. Accordingly, in another aspect of the present invention, a control method includes driving a hydrostatic drive system to rotate a rotor assembly of a concrete finishing trowel at a commanded speed. The method further includes driving the hydrostatic drive system to rotate the rotor assembly at a slower-than-operator-commanded rotational speed if the speed of the engine powering the hydrostatic drive system falls below a threshold speed.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
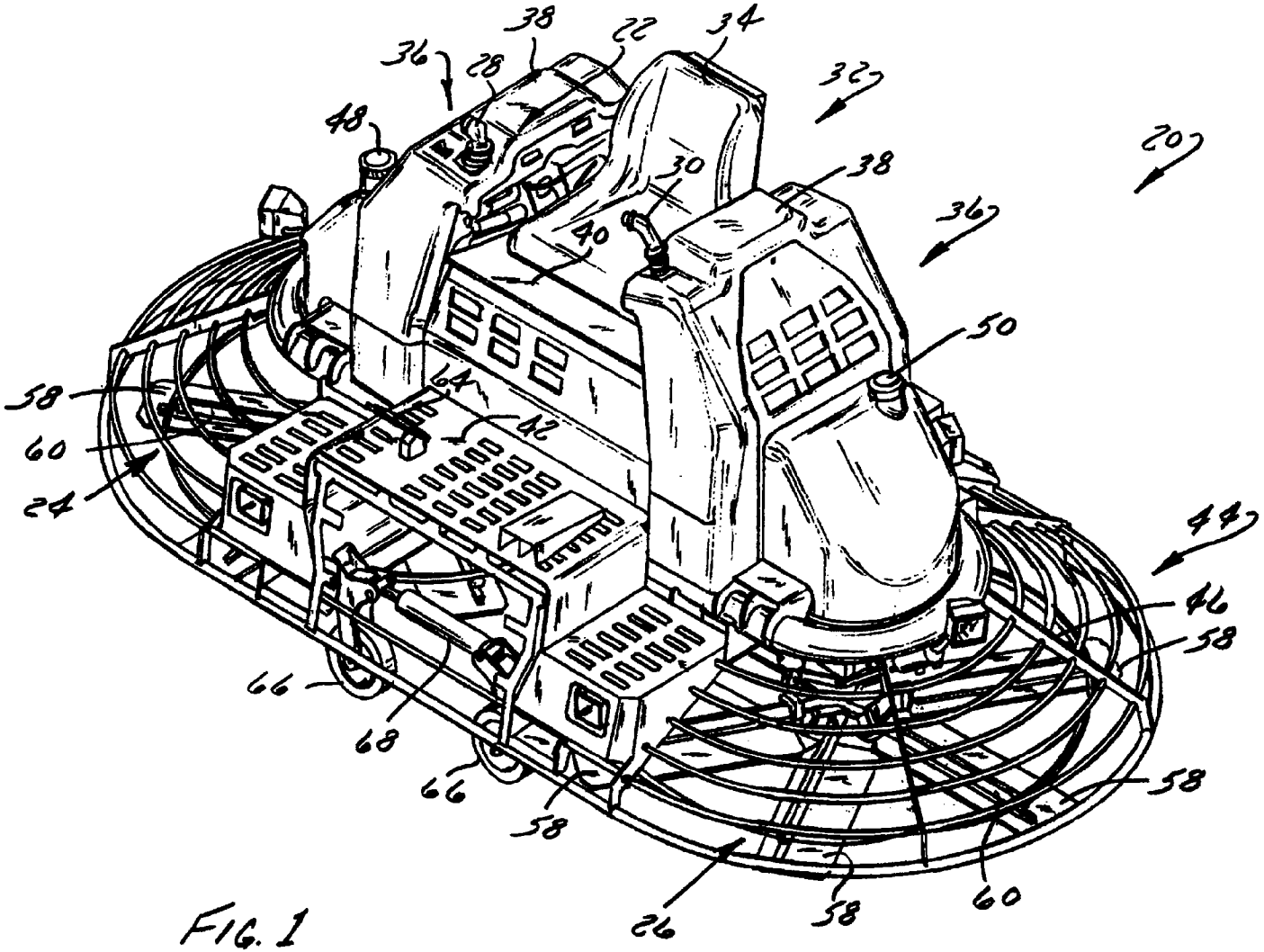
FIG. 1 is a front perspective view of a riding power trowel according to a preferred embodiment the present invention.
Figure 2:
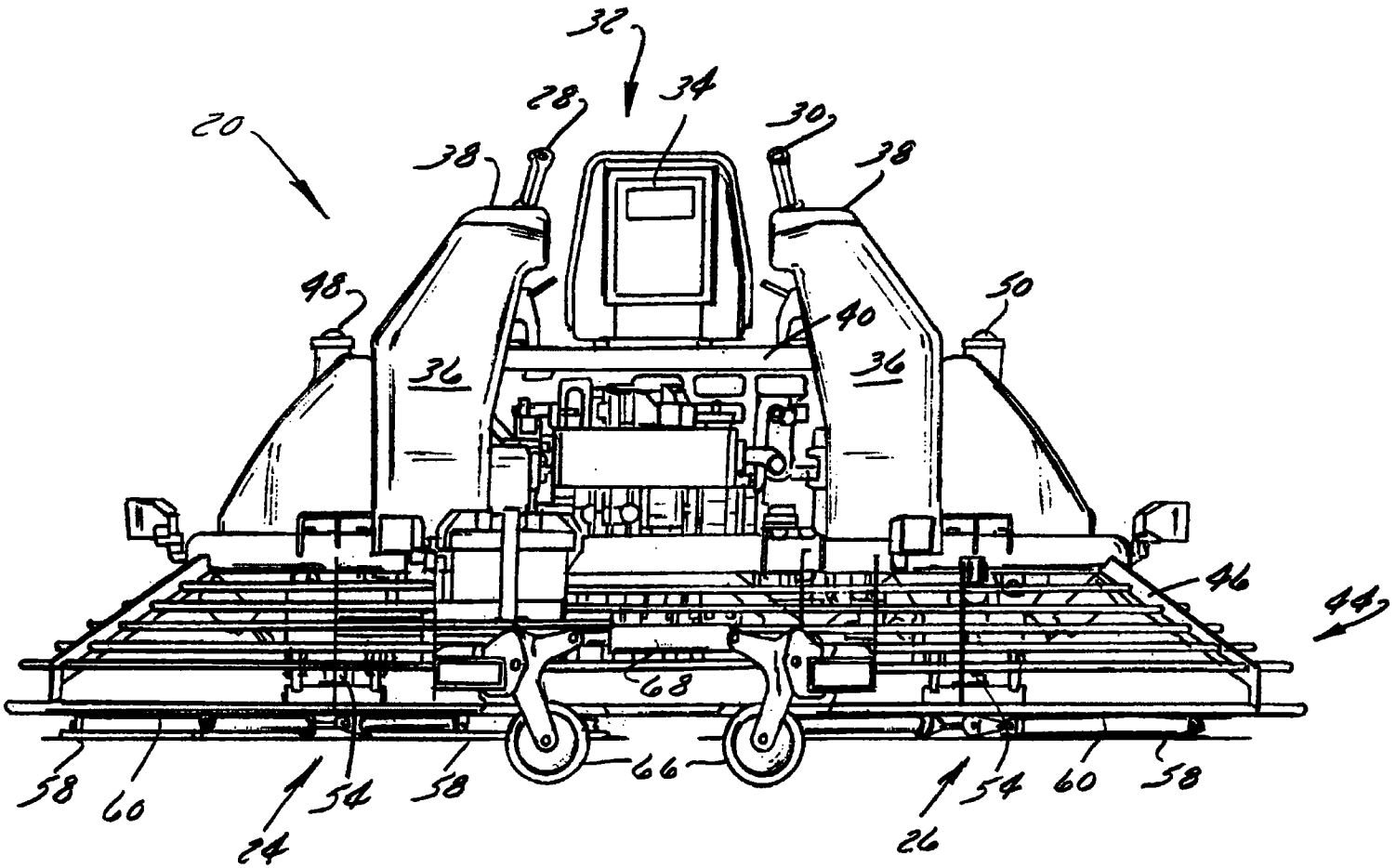
FIG. 2 is a rear elevation view of the riding trowel shown in FIG. 1 with a portion of the front frame removed to expose portions of the machine's propulsion system.

FIGS. 1 and 2 show a self-propelled riding concrete finishing trowel 20 equipped with a propulsion and steering system 22 and two or more rotor assemblies 24, 26. The propulsion and steering system 22 drives the rotor assemblies to rotate and also steers machine 20 by tilting the rotor assemblies 24, 26 of machine 20, as described in greater detail below. The rotor assemblies 24 and 26 rotate towards the operator, or counterclockwise and clockwise, respectively, to perform a finishing operation. Propulsion and steering system 22 is controlled by a foot pedal 46 for inputting a rotor speed command.

Each rotor assembly 24, 26 includes a driven shaft 54 extending downwardly from a hydraulic motor 56 and a plurality of circumferentially-spaced blades 58 supported on the driven shaft 54 via radial support arms 60. Blades 58 extend radially outwardly from the bottom end of the driven shaft 54 so as to rest on the concrete surface. During operation, blades 58 support the entire combined weight of the operator and trowel 20 on the surface to be finished. Each drive motor 56 is mounted within frame 46 so as to be tiltable relative to frame 46, such as described in U.S. Publication No. 2010/0254763, the disclosure of which is incorporate herein.

As is typical of riding concrete finishing trowels of this type, trowel 20 is steered by tilting a portion or all of each of the rotor assemblies 24 and 26 so that the rotation of the blades 58 generates horizontal forces that propel machine 20. The steering direction is generally perpendicular to the direction of rotor assembly tilt. Hence, side-to-side and fore-and-aft rotor assembly tilting cause machine 20 to move forward/reverse and left/right, respectively. As described in U.S. Pat. No. 7,775,740, the disclosure of which is incorporated herein, the most expeditious way to effect the tilting required for steering control is by tilting the entire rotor assemblies 24 and 26, including the respective drive motors 56.

Rotor tilting is initiated via the steering command signal generators that comprise joysticks 28 and 30 in the illustrated embodiment but that could conceivably take the form of levers or other devices. The joysticks 28, 30 are positioned proximate an area to be occupied by an operator of finishing trowel 20. Steering system 22 may also include a selector (not shown) that can be operated to alter the responsiveness of trowel 20 to steering input signals associated with movement of joysticks 28, 30.

Still referring to FIGS. 1-2, as is commonly understood with respect to riding finishing trowels, operator area 32 includes a seat 34 that flanked by a pair of towers 36 so that an operator is generally centrally positioned between or flanked by the joysticks 28, 30. The towers 36 each have an upper flat surface 38 located adjacent opposite lateral sides of the seat 34 to provide arm rests for the operator while seated on the chair. Seat 34 is supported by a generally rigid metallic frame or pedestal 40. A deck 42 for supporting the operator's feet is located in front of pedestal 40. A shroud or cage 44 is attached to frame assembly 46 and extends in an outward direction relative to operator area 32. Preferably, cage 44 extends at least slightly beyond a rotational footprint associated with operation of rotor assemblies 24, 26. Cage 44 prevents or reduces the incidence of unintended impacts or contacts of rotor assemblies 24, 26 with other devices and structures associated with operation of trowel 20. Cage 42 is positioned at the outer perimeter of machine 20 and extends downwardly from frame 46 to the vicinity of the surface to be finished. A fuel tank 48 is disposed adjacent the right side of operator area 32, and a water retardant tank 50 is disposed on the left side of the operator area 32. As best shown in FIG. 1, the fuel tank 48 and the water retardant tank 50 are mounted on opposite sides of the towers 36. Hand grips (not shown) may be attached to the front surfaces of the towers 36 to assist the operator in climbing into and out of the seat 34.

Retractable wheels 66 may be pivotally supported on the frame to facilitate machine transport to and from the work area. Two sets of wheels 66 are provided on the front and rear of the machine, respectively. Each wheel set includes two wheels pivotally mounted to the frame 46 and deployable by a double acting hydraulic cylinder 68.

Both rotor assemblies 24 and 26, as well as other powered components of the finishing trowel 20, are driven by a power source, such as internal combustion engine 62, mounted under operator's seat 34, as seen in FIG. 2. The size of engine 62 will vary with the size of the machine 20 and the number of rotor assemblies powered by the engine. The illustrated two-rotor 60" machine typically will employ an engine of about 66 hp. The speed of the engine preferably is controlled so that the engine is at full throttle whenever the rotor assembles are being drive to rotate.

Figure 3:
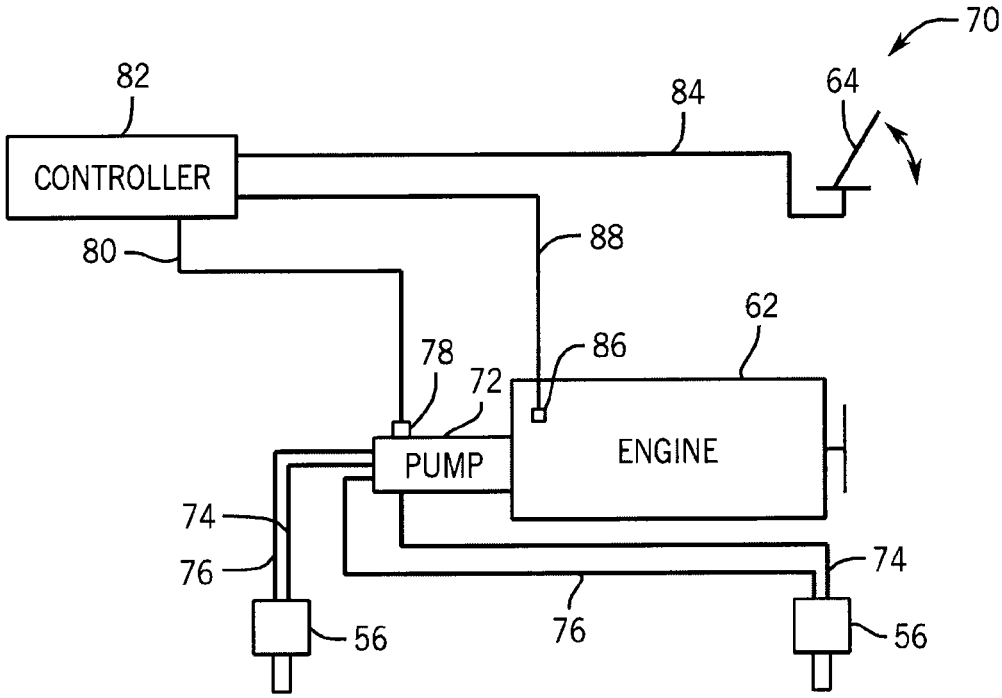
FIG. 3 is a schematic representation of an engine droop control system of the riding power trowel show in FIG. 1.

As noted above, each rotor assembly 24, 26 is powered by the engine 42 indirectly through a respective hydraulic drive motor 56. In a preferred embodiment, the drive motors 56 form the outputs of a hydrostatic drive system 70. As best seen in FIG. 3, in addition to the aforesaid drive motors 56, the hydrostatic drive system 70 includes a hydrostatic pump 72 that is powered by engine 62 to circulate hydraulic fluid to the hydraulic drive motors 56 through supply lines 74 and return lines 76. Operation of the hydrostatic pump 72 is governed by a solenoid controlled electro-hydraulic proportional control valve 78 that controls the output of the pump 72 based on a proportional current signal received across a communication line 80 from a controller 82. The controller 82 provides the proportional current signal to the valve 78 based on a proportional voltage signal received from a foot pedal 64 via a communication line 84. As noted above, the foot pedal 64 enables the operator to input a commanded rotating speed for the rotor assemblies 24, 26, but it is understood that other input devices could be used to input a desired speed. An engine speed sensor 86 monitors the operating speed of the engine 62 and provides an output signal to the controller 82 across communication line 88. Under certain operating conditions described in detail below, the controller 82 adjusts operation of the pump 72 via command signals through control valve 78 based on the operating speed of the engine.

During normal operation, the seated operator depresses foot pedal 64 an amount that corresponds to a desired rotor assembly rotational speed. Depressing the foot pedal 64 causes a voltage signal to be sent to the controller 82 across communication line 84 that is proportional to the degree of foot pedal 64 depression. Typically, the operator will fully depress the foot pedal 64 to drive the rotor assemblies at a maximum velocity. The controller 82 then converts the voltage signal to a proportional current signal that is communicated to a solenoid of the proportional control valve 78 across communication line 80. As known in the art, the magnitude of the current signal dictates the volume of fluid the pump 72 delivers to the hydraulic drive motors 56, which in turn rotate the rotors 24, 26 accordingly. The engine 62 powers the pump 72 to supply pressurized hydraulic fluid to the drive motors 56.

The blades 58 rotate against the surface of the concrete at the operator-commanded speed. However, as conditions of the concrete vary, the amount of friction between the blades and the concrete can change. If the amount of friction increases, the torque load on the engine will also increase, decreasing the operating speed of the engine. If the torque load is sufficiently large, the engine could stall. Excessive engine speed reduction is prevented by overriding input to the solenoid of the control valve 78 if the engine speed falls below a threshold value.

Figure 4:
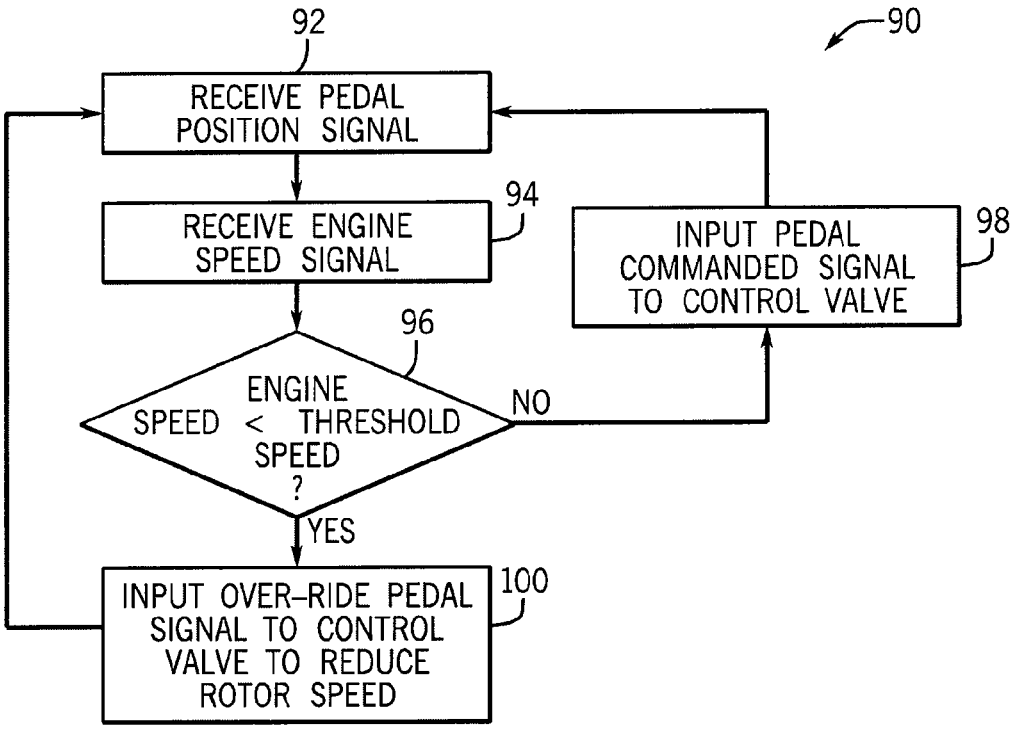
FIG. 4 is a flow chart that shows an exemplary embodiment for operation of the engine droop control system shown in FIG. 3.

The preferred control technique is illustrated diagrammatically via the flowchart of FIG. 4. The process 90 represented by that flowchart begins at block 92 with the controller 82 receiving the proportional voltage signal from the foot pedal 64. The controller also receives the engine speed signal from sensor 86 at block 94 and compares the actual engine speed to a threshold speed in block 96. That threshold speed may be a pre-set speed that is a designated amount of, for example, 100 RPM below the maximum rated engine speed. In the illustrated example in which the maximum rated engine operating speed is 2,800 RPM, the threshold may be 2,700 RPM. Alternatively, the threshold speed could be selected from a look-up table based on at least the commanded rotor speed as determined by pedal position and possibly taking one or more other factors into account as well, such as a blade pitch. A look-up table could also take commanded engine speed into account in a machine having a variable engine speed capability. If the monitored engine speed is above the threshold speed, the controller 82 provides a signal to the valve 78 to control the hydraulic motors 56 to drive the rotors 22, 24 to rotate at the commanded speed in block 98.

If, on the other hand, the monitored engine speed is below the threshold speed, the controller 82 provides a current signal to the valve 78 at block 100 that is independent of the proportional voltage signal input to the controller 82 by the operator via the foot pedal 64. This "over-ride" signal causes the pump 72 to deliver a reduced volume of hydraulic fluid to the motors 56 and thereby drives the motors 56 to rotate the rotors 24, 26 at a slower speed. Doing so reduces the power draw on the engine 62 so that the engine does not stall. The process then returns to block 92 and cycles through blocks 92, 94, 96, and 100 until the engine speed increases above the threshold. That is, once the frictional load from the concrete surface decreases, the blades 58 will begin to rotate faster. The reduction in frictional load can occur because of a number of factors, such as a change in concrete conditions or a change in blade pitch. In any event, when the engine speed increases above the threshold, the controller 82 will return operation of the control valve 78 based on the operator input to the foot pedal 64. The over-ride input to the control valve 78 thus reduces the power draw on the engine but does not reduce the power supplied to the engine. This enables the engine to accelerate automatically when the frictional load on the engine is decreased.

Figure 5:
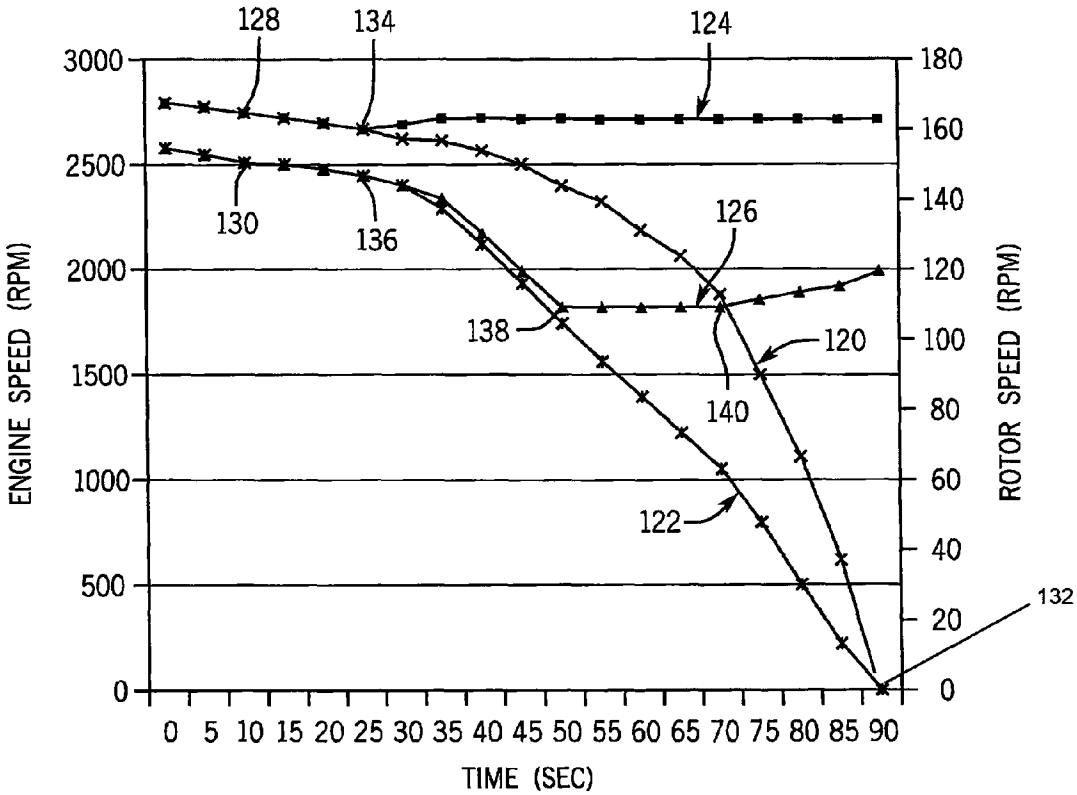
FIG. 5 is a graph showing exemplary response characteristics that can be attained with the engine droop control system shown in FIG. 3.

The effects of the above-described droop control are illustrated graphically by the curves 120, 122, 124, 126, in FIG. 5. Curves 120 and 122 plot engine speed and rotor speed, respectively, versus time in a trowel constructed as discussed in conjunction with FIGS. 1 and 2 but lacking the droop control capabilities discussed above in connection with FIGS. 3 and 4. Both curves show the engine and rotors operating at full speed under conditions in which the load imposed on the engine by the rotors start to overload the engine, resulting in reduction in both engine speed and rotor speed at points 128 and 130, respectively. Engine and rotor speed thereafter both fall dramatically, resulting in complete engine stall at point 132.

Curves 124 and 126 show the response of the same machine under the same operating conditions in which the droop control technique discussed above in connection with FIGS. 3 and 4 is implemented. At point 134 on curve 124, the engine speed drops below the threshold speed which, in the illustrated embodiment in which the engine's maximum rated speed is 2,800 RPM, is 2,700 RPM. The rotors rotate at about 150 RPM at this time. The controller 82 then overrides the operator command signal and to decrease the output of proportional control valve. Engine speed immediately rebounds to the threshold speed. From points 136 to point 138 on curve 126, the controller 82 controls the proportional control valve to continue to reduce rotor speed, indicating that further torque reduction is needed to keep the engine speed from falling beneath the threshold. From points 138 to 140 on curve 126, further rotor speed reduction is unnecessary to maintain engine speed operation at the threshold reduce speed. That rotor speed is approximately 110 RPM in the illustrated example, but might vary significantly depending upon the actual operating conditions of the trial. The controls signal to the proportional control valve 78 thereafter remains at this reduced level until point 140, when rotor speed begins to increase due to improved operating conditions. At some point (not shown in these curves), operating conditions may improve to the point to which the above-described droop control is no longer necessary, at which time rotor speed and engine speed will both be in the regions illustrated to the left of the points 134 and 136 in curves 124 and 126.

The self-propelled concrete finishing trowel described above and shown in FIGS. 1-2 represents one exemplary apparatus that can benefit from the present invention. In this regard, it is understood that the present invention may be used with other types of ride-on trowels and even walk behind self-propelled trowels. Moreover, it is contemplated that conventional self-propelled trowels can be retrofitted to include the engine load management system of the present invention. Further, it will be appreciated that, while the engine droop control system of the present invention reduces the flow of hydraulic fluid to the hydraulic motors during engine overload conditions, the control system does not prevent pressure from increasing to address an increasing torque.

It is appreciated that many changes and modifications could be made to the invention without departing from the spirit thereof. Some of these changes, such as its applicability to riding concrete finishing trowels having other than two rotors and even to other self-propelled powered finishing trowels, are discussed above. Other changes will become apparent from the appended claims. It is intended that all such changes and/or modifications be incorporated in the appending claims.

I claim:

1. A powered rotary trowel comprising:
- an engine;
- a frame that supports the engine;
- at least one rotor assembly that is driven by the engine through a hydrostatic drive system, the hydrostatic drive system including a motor for driving the rotor assembly to rotate and a pump that is powered by the engine to deliver a variable volume of hydraulic fluid to the motor;
- a proportional control valve that meters fluid flow through the pump based on an operator generated command;
- an engine speed sensor; and
- a controller that receives engine speed information from the engine speed sensor and that provides a command signal to the proportional control valve over-riding the operator generated command when the engine is operating at an engine speed that is below a threshold engine speed.

2. The powered rotary trowel of claim 1, wherein the at least one rotor assembly includes a first rotor assembly and a second rotor assembly.

3. The powered trowel of claim 2, wherein a separate motor is provided for each of the first and second rotor assemblies, and wherein a single pump supplies pressurized fluid to both motors.

4. The powered rotary trowel of claim 1, further comprising an operator manipulatable input device that generates the operator command.

5. The powered rotary trowel of claim 4, wherein the operator manipulatable input device includes a foot pedal that provides a voltage signal that is proportional to a magnitude of pedal depression.

6. The powered rotary trowel of claim 1, wherein the threshold speed is a predetermined speed beneath a maximum rated engine speed.

7. The powered rotary trowel of claim 1, wherein the controller is further configured to provide a new command signal to the proportional control valve that corresponds to the operator generated command signal when the speed of the engine increases to a value greater than the engine threshold speed.

8. The powered rotary trowel of claim 1, wherein the trowel is a ride-on trowel having a seat for supporting an operator.

9. A powered rotary trowel comprising:
- an engine;
- a frame that supports the engine and an operator;
- at least first and second rotor assemblies;
- an operator manipulatable input device that generates a rotor assembly drive speed command signal;
- a hydrostatic drive system including a variable output hydraulic pump and first and second motors, each of which is coupled to the pump and to one of the rotor assemblies;
- an electronically controlled proportional control valve that meters the variable volume of hydraulic fluid to be delivered to the first and second motors by the pump;
- an engine speed sensor; and
- a controller that is operationally coupled to the engine speed sensor, to the input device, and to the proportional control valve and that controls the proportional control valve to meter fluid flow through the pump to
  - drive the rotor assemblies at a speed commanded by the input device so long as the engine speed is above a threshold, and
  - drive the rotor assemblies at a speed that is beneath the speed commanded by the input device so long as the engine speed is below the threshold.

10. The powered rotary trowel of claim 9, wherein the input device is a foot pedal that provides a proportional voltage signal to the controller corresponding to the operator commanded rotor speed.

11. A method of preventing engine stall in a powered rotary trowel having an engine and a hydrostatic drive system that causes rotation of at least one rotor assembly, the method comprising:
- controlling the hydrostatic drive system to drive the rotor assembly to rotate based on an operator input command signal;
- monitoring a speed of the engine during operation of the rotary trowel;
- comparing the engine speed to a threshold speed; and
- automatically controlling the hydrostatic drive system to override the command signal so as to reduce a power draw on the engine if the monitored engine speed drops below the threshold speed.

12. The method of claim 11, wherein the controlling step results in a reduction in rotor speed.

13. The method of claim 11, further comprising returning control of the hydrostatic drive system to that commanded by the command signal if the monitored engine speed rises above the threshold speed.

14. The method of claim 11, wherein the threshold speed is a predetermined engine speed that is beneath a maximum rated engine speed.

15. The method of claim 11, wherein the operator input is command signal is a proportional voltage signal generated by depressing a foot-pedal.

16. An electronically controlled engine droop control that prevents stalling of an engine of a concrete finishing trowel during overload conditions, the engine droop control comprising:

an engine speed sensor that monitors an operating speed of the engine; and a controller that adjusts operation of a hydrostatic drive system of the trowel based on feedback received from the engine speed sensor to reduce the power draw on the engine during overload conditions.

17. The electronically controlled engine droop control of claim 16, wherein the controller adjusts operation of the hydrostatic drive system to slow flow of hydraulic fluid to a hydraulic motor that drives a rotor assembly of the trowel to rotate.

18. The electronically controlled engine droop control of claim 17, wherein the controller adjusts operation of the hydrostatic drive system to slow fluid flow to the hydraulic motor without inhibiting an increase in hydraulic fluid flow to the hydraulic motor in response to an increase in torque demand on the engine.

* * * * *